US005639000A

United States Patent [19]

McDaniel et al.

[11] Patent Number: 5,639,000

[45] Date of Patent: Jun. 17, 1997

[54] WATCH BAND ASSEMBLY

[76] Inventors: V. Robin McDaniel; O. Kevin McDaniel, both of P.O. Box 9711, Panama City Beach, Fla. 32417

[21] Appl. No.: 517,776

[22] Filed: Aug. 21, 1995

[51] Int. Cl.[6] ..... A44C 5/00; A44C 5/04

[52] U.S. Cl. ..... 224/175; 224/164; 224/180; 24/265 WS; 24/301; 24/662; 24/706.9; 63/5.1; 368/282

[58] Field of Search ..... 224/164, 172, 224/175, 176, 177, 180; 63/5.1, 5.2; 24/265 WS, 662, 706.9, 300, 301; 368/281, 282

[56] References Cited

U.S. PATENT DOCUMENTS

| | | | |
|---|---|---|---|
| 2,530,964 | 11/1950 | Hirsch | 63/5.2 |
| 2,747,779 | 5/1956 | Speck et al. | 24/265 WS |
| 2,751,132 | 6/1956 | Myerson | 224/175 |
| 2,763,124 | 9/1956 | Greene | 63/5.2 |
| 2,785,453 | 3/1957 | Wentz | 24/662 |
| 2,800,696 | 7/1957 | Aicher | 24/300 |
| 4,401,388 | 8/1983 | Mearns | 386/282 |
| 4,414,719 | 11/1983 | Capolupo | 24/265 WS |
| 4,559,677 | 12/1985 | Tracy | 24/300 |
| 4,798,569 | 1/1989 | Alderfer | 24/662 |
| 4,856,687 | 8/1989 | Iwamura et al. | 224/164 |

FOREIGN PATENT DOCUMENTS

| | | | |
|---|---|---|---|
| 999392 | 1/1952 | France | 24/265 WS |
| 1166373 | 11/1958 | France | 224/177 |
| 76721 | 2/1918 | Switzerland | 224/175 |
| 290969 | 8/1953 | Switzerland | 63/5.2 |
| 149578 | 8/1920 | United Kingdom | 224/164 |
| 604261 | 6/1948 | United Kingdom | 63/5.1 |
| 828290 | 2/1960 | United Kingdom | 24/265 WS |

*Primary Examiner*—Renee S. Luebke
*Assistant Examiner*—Gregory M. Vidovich
*Attorney, Agent, or Firm*—Carnes, Cona and Dixon

[57] ABSTRACT

The watch band assembly includes a pair of buckle devices and a strap assembly. The buckle devices are fabricated to be a one piece structure which are adapted to be removably secured to opposite ends of a conventional watch. Extending outwardly from the buckle devices are studs that are adapted to receive and maintain the strap assembly. The strap assembly is comprised of at least one elongated tubular member having opposite ends. These ends are adapted to be releasably secured to the buckle devices.

14 Claims, 2 Drawing Sheets

WATCH BAND ASSEMBLY

BACKGROUND OF THE INVENTION

1. Field of the Invention

The present invention relates generally to a watch band assembly that is adapted to be removably secured to a conventional watch, and more particularly to a watch band device that is fabricated from an elastic and resilient tubular material that will provide for a watch assembly that is not only durable, long lasting, but is also aesthetically pleasing.

2. Description of the Prior Art

The concept of a removable watch band has been around for many years. The idea allows a worn watch band to be replaced thereby allowing the continued use of the wrist watch itself. Traditionally, removable watch bands utilize non-elastic material in combination with a clasp or buckle to allow the watch to be removed without separating the band from the watch. However, with the growth in popularity of wrist watches, a market has been created providing more unique and aesthetically pleasing watch bands made from a variety of materials other than those traditionally used, i.e., leather.

One such device is disclosed in U. S. Pat. No. 4,401,388 issued to Mearns. Mearns discloses a watch band or bangle, comprising a bezel, having first and second lugs, that is secured to a conventional wrist watch. A bangel is held within the lugs. The design and configuration does provide for an assembly that is attractive, however, this structure does suffer some drawbacks. One drawback is that this watch band cannot be used in order to replace a worn conventional band on a conventional watch, since most conventional watches use pins for attachment. Additionally, the use of a bezel would provide a possibility for dust or the like to be located therein, inherently providing for an unattractive structure.

Yet another device is disclosed in U.S. Pat. No. 4,414,719 issued to Capolupo. Capolupo discloses a pin type retention device that is used for securing a watch band to a watch. This retention device includes a retainer clip, secured to a watch band strap, that is adapted to receive and retain tongues, that are secured to the watch. Though successful, the use of the clip and tongues may provide a device that can catch onto hair or skin of the wrist, thereby providing for an uncomfortable fit. Further, the various components used to install the device onto the strap are extremely small, rendering a device that is difficult to install.

Yet another watch device is disclosed in U.S. Pat. No. 4,855,972 issued to Eiss, wherein there is disclosed a watch case for a tennis bracelet. This watch case is designed solely for use with a conventional bracelet and cannot be retrofitted onto a conventional watch, therefore limiting the use of the watch.

None of these previous efforts, however, provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for a band assembly that is adapted to be removably secured to a conventional watch.

The band assembly comprises a buckle device and strap assembly. The buckle device is designed to be removably attached to the watch, while the strap assembly is configured to be removably secured to the buckle device.

This buckle device is designed to provide the band assembly with flexibility as well as provide an assembly that will enable a watch to be maintained on a flat and stable position on the wrist of the user. Additionally, this buckle device is adapted to be retrofitted on any style or type of watch.

The strap is configured to be comprised of at least one elongated tubular member. The tubular member is fabricated from a material possessing resilient and elastic properties, inherently adding to the flexibility of the strap as well as adding to the comfort of the band assembly.

Accordingly, it is an object of the present invention to provide for a watch band assembly which will overcome the deficiencies, drawbacks, and disadvantages of conventional watch band assemblies while still providing a unique and attractive watch band for use with a wrist watch.

It is another object of the present invention to provide for a watch band assembly that can be customized and sized by the consumer by enabling the strap to be cut to the appropriate size is desired by the user.

It is still another object of the present invention to provide a watch band assembly that is flexible and will conform to the contour of the wrist of the individual wearing the watch band assembly.

A final object of the present invention, to be specifically enumerated herein, is to provide a watch band assembly in accordance with the preceding objects and which will conform to conventional forms of manufacture, of simple construction and easy to use to provide a device that would be economically feasible, long lasting and relatively trouble free in operation.

Although there have been many inventions related to a watch band assembly, none of the inventions have become sufficiently compact, low cost, aesthetically pleasing, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

As illustrated in the figures, the watch band assembly 10*a* is adapted to be removably secured to a conventional watch. The watch band assembly 10*a* comprises a strap assembly 12 having opposite ends, and a buckle device 14 for receiving each end of the strap.

Figure 1:
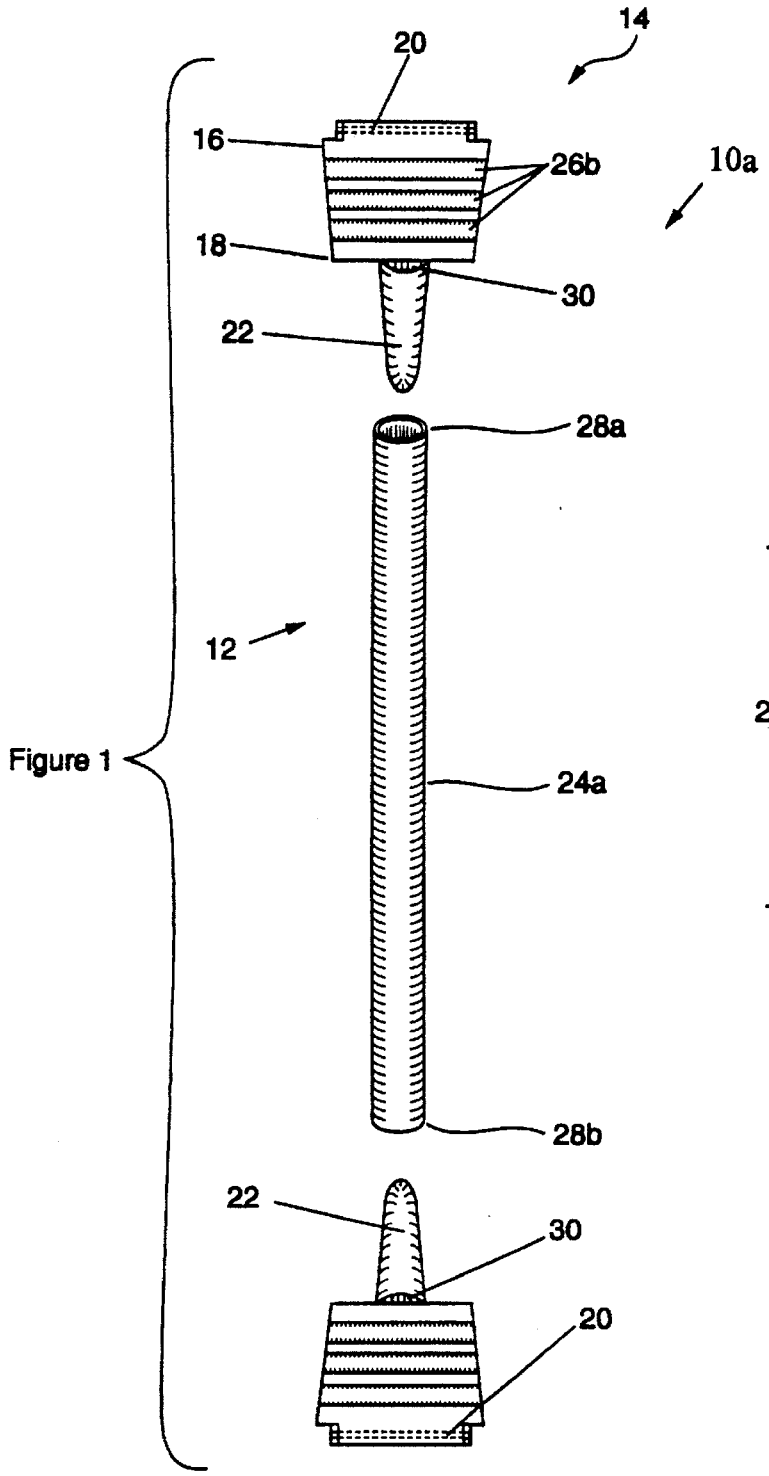
FIG. 1 is a front planar view of the first embodiment of the watch band assembly of the present invention, prior to the installation of the strap to the buckle device.
Figure 2:
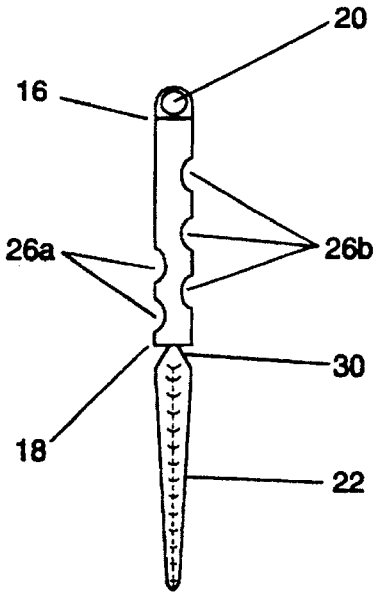
FIG. 2 is a side view of the buckle device used with the watch band assembly of the present invention.

As seen in FIGS. 1 and 2, the first embodiment of the present invention, the buckle device 14 comprises a first portion 16 and a lower portion 18. Located at the first portion 16 and extending horizontally therethrough is a first channel 20. This channel 20 is adapted to receive conventional spring loaded pin for enabling the buckle device 14 to be secured to a conventional watch.

The lower portion 18 of the buckle device further includes a front surface and a back surface. Located on both surfaces are a plurality of grooves 26*a* and 26*b*, respectively. The grooves 26*a* located on the front surface are not in alignment with the grooves 26*b* located on the back surface. The grooves 26*a* located on the front surface are displaced from the grooves 26*b* located on the back surface. This will provide for the buckle device 14 to be flexible, yet rigid enough to be maintained on a flat and stable position on the wrist of the user. The grooves constitute a flexing means.

Extending downwardly from the lower portion 18 is a stud or leg 22. This stud or leg 22 decreases in width from the top to the bottom to provide for the stud or leg 22 to receive the strap assembly 12. Also located on the top of the stud or leg 22 is a step 30. This step 30 causes the width to remain the same at the first portion, but causes the depth to decrease in size. This step 30 increases the difficulties for the removal of the elongated tubular member, while it decreases the difficulties of attaching the strap to the buckle device.

Preferably, this buckle device is a one piece construction comprised of a material of rubber or the like. This will provide for a buckle assembly that is waterproof, durable, and flexible. Additionally, the use of rubber material or the like will provide for a buckle device permitting the strap assembly to be easily attached thereto, but is not easily pulled out without considerable, deliberate exertion.

The strap assembly 12 in this embodiment comprises a first elongated resilient tubular member 24*a*. This tubular member 24*a* is typically fabricated from a variety of material, such as, but not limited to latex, elastomeric foam, neoprene, synthetic rubber, a mixture thereof, or the like. Additionally, this tubular member can include any design or be painted any color, such as neon or bright colors.

As seen, this tubular member 24*a* is hollow and includes opened opposite ends 28*a* and 28*b*, respectively. These ends 28 and 28*b* are adapted to receive the stud or leg 22 of the buckle device 14.

Accordingly, in order to utilize the first embodiment of the present invention, the user merely inserts the stud or leg 22 into the ends of the tubular member. Due to tubular member being fabricated from a material having a high coefficient of friction, the tubular member will remain on the stud or leg 22 in a fixed position. Once the tubular member is secured onto the stud or leg, removal requires the application of a force along the axis of the tubular member. The elastic properties of the material comprising the strap assembly causes the diameter of the tubular member to decrease as the tubular member is stretched by the axially applied force. This, in essence, creates a force normal to the elongated tubular member which resists expansion. The configuration of the stud or leg utilizes this normal force to retain the tubular member by providing a larger diameter step which the very end portion of the tubular member must expand to overcome in order to be removed. As the tubular member is pulled axially, the normal force increases making expansion to overcome the step increasingly difficult. However, the properties of the material will allow the normal force to be overcome if sufficient axially force is applied. The unique configuration of the stud or leg of the present invention ensures that this axial force required for removal is much higher than any unintentional forces acting on the watch and band assembly while being worn.

It is noted that the tubular member is fabricated from a flexible, yet resilient, material thereby giving the user with the option to cut and adjust the size of the strap to provide for a tight fit or for a looser fit.

Figure 3:
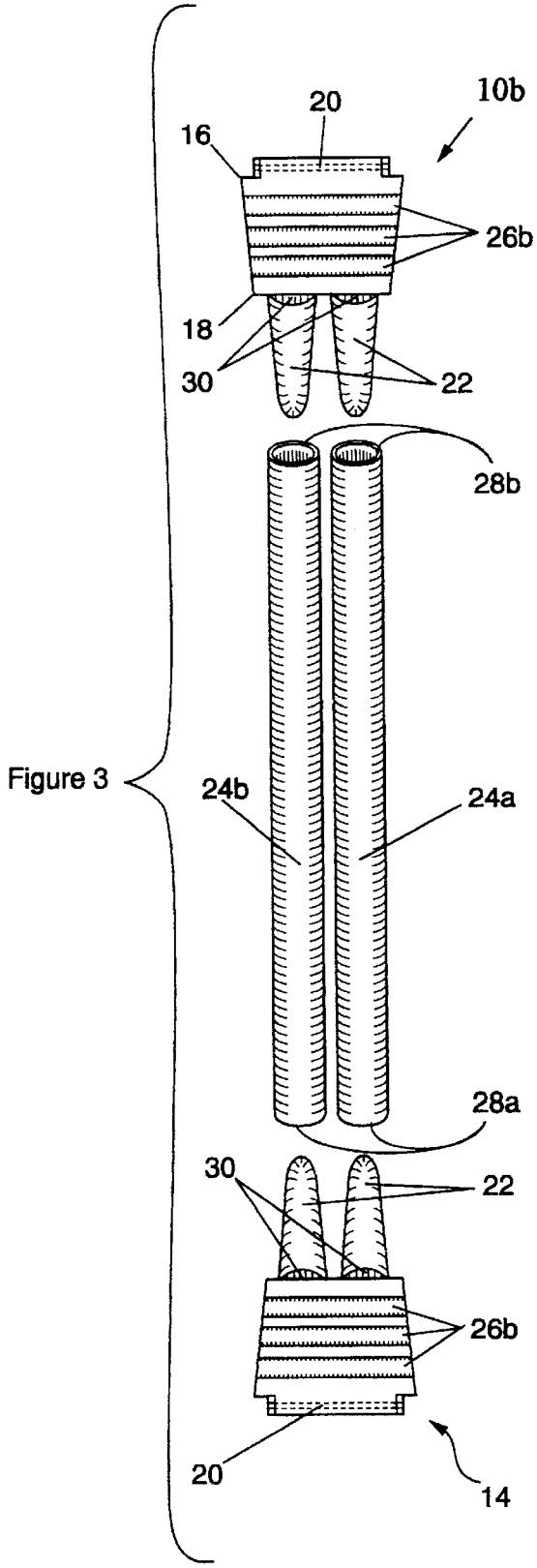
FIG. 3 is a front plane view of the second embodiment of the watch band assembly of the present invention, prior to the installation of the strap assembly to the buckle device.

The above-described embodiment can be altered to provide for the strap to include at least two tubular members. This alteration is illustrated in further detail in FIG. 3. As seen in this figure, of the second embodiment 10*b* the strap assembly 12 includes a first tubular member 24*a* and a second tubular member 24*b*. To accommodate for the additional tubular members, the buckle device 14 includes first and second stud or leg members 22. These studs or legs are designed and configured to receive the opposite ends of the tubular members 24*a* and 24*b*, respectively.

It is noted that the described embodiments are not limited solely to one or two tubular members for the strap, and that a plurality of tubular members can be utilized, such as three or four tubular members. With the addition of each tubular member, there will be an addition of a stud or leg to the buckle device. Additionally, the materials used for the various components described above are the same used and described in the first embodiment.

Figure 4:
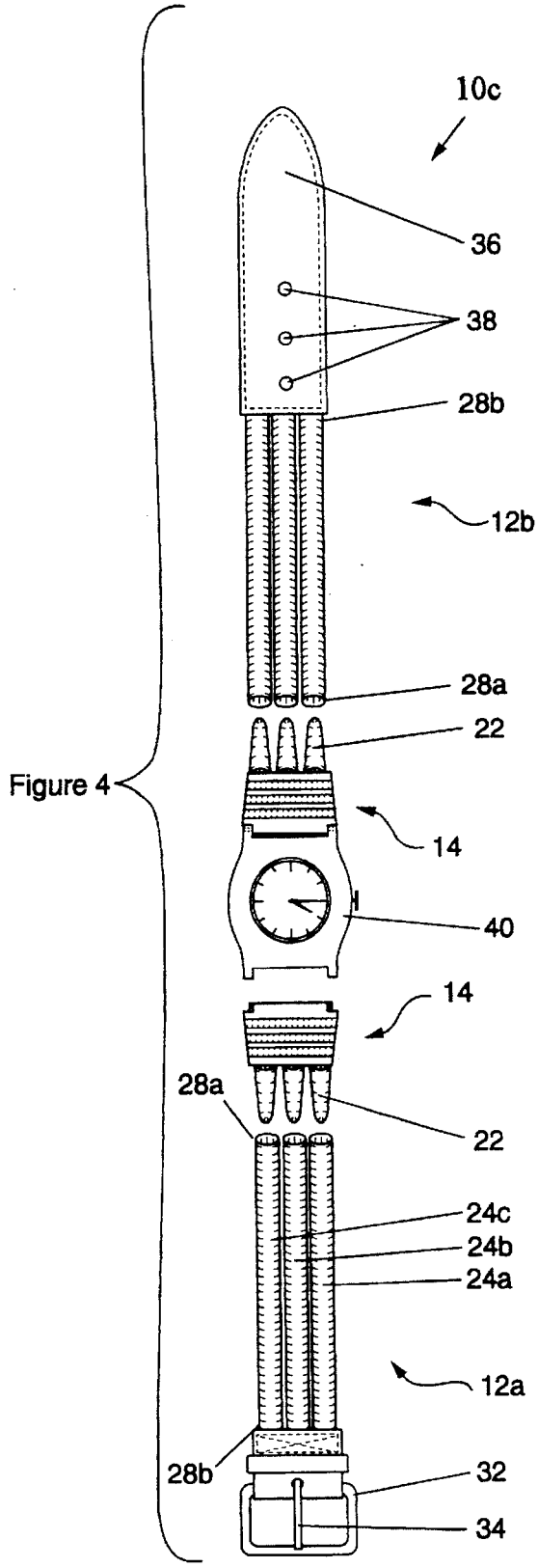
FIG. 4 is a front view of a third embodiment of the watch band assembly of the present invention.

The above described embodiments can be altered to provide for a clasp or a buckle. This embodiment is illustrated in further detail in FIG. 4. As seen in this embodiment, watch band assembly 10 includes a first strap assembly 12*a* and a second strap assembly 12*b*. Each strap assembly is constructed from at least one tubular member. In this figure there is illustrated three tubular members 24*a*, 24*b*, and 24*c* for each buckle device 14. Secured on one end of the first strap assembly is a buckle or clasp 32 having a buckle tongue 34. The opposite end is adapted to receive the stud or leg of the buckle device. The second strap assembly includes a tongue 36 having a plurality of evenly spaced perforations. These perforations are adapted to be received by the buckle tongue 34. The opposite end is adapted to receive the stud or leg of the buckle device.

While the invention has been particularly shown and described with reference to an embodiment thereof, it will be understood by those skilled in the art that various changes in form and detail may be made without departing from the spirit and scope of the invention.

We claim:

1. A watch band assembly used in combination with a watch comprising:

a first buckle device and a second buckle device;

said first buckle device and said second buckle device each have an inner end adapted to be removably secured to said watch;

said first buckle device and said second buckle device are rigid and each include a flexing means, for enabling said first buckle device and said second buckle device to be rigid yet flexible;

a strap assembly;

said strap assembly comprises at least one elongated hollow integral tubular resilient member having opposite ends which are opened and said at least one elongated hollow integral tubular resilient member maintains a hollow integral tubular shape when stretched; and said opposite ends of said strap assembly are removably secured to an outer end of said first buckle device and to an outer end of said second buckle device, respectively, via an attaching means wherein each said buckle device include a front surface and a back surface, said front surface includes a plurality of first grooves that are horizontally disposed with respect to said inner end and said outer end, said back surface includes a plurality of second grooves that are horizontally disposed with respect to said inner end and said outer end wherein said plurality of first grooves and said plurality of second grooves constitute said flexing means.

2. A watch band assembly as in claim 1 wherein said attaching means includes at least one stud extending from each said outer end of said buckle devices which removably receive said opposite ends, said at least one stud includes and inner end and an outer end, said outer end of said at least one stud receives said strap assembly, and said inner end to said outer end of said at least one stud gradually decreases in width for providing for said at least one stud to be tapered from said inner end to said outer end thereof.

3. A watch band assembly as in claim 1 wherein said inner end of said first buckle device and said second buckle device includes a receiving means for receiving a conventional pin for enabling said first buckle device and said second buckle device to be releasably secured to said watch.

4. A watch band assembly as in claim 3 wherein said receiving means is a horizontally disposed channel.

5. A watch band assembly as in claim 2 wherein said inner end of said least one stud further includes a step for providing for said inner end of said at least one stud to include an inward tapered tip which decreases in depth from said inner end of said at least one stud.

6. A watch band assembly as in claim 1 wherein said plurality of first grooves are displaced from said plurality of second grooves.

7. A watch band assembly as in claim 5 wherein said plurality of first grooves are displaced from said plurality of second grooves.

8. A watch band assembly as in claim 1 wherein said at least one elongated hollow tubular resilient member comprised of a material selected from the group consisting of synthetic rubber, latex, elastomeric foam, and a mixture thereof.

9. A watch band assembly as in claim 7 wherein said at least one elongated hollow tubular resilient member comprised of a material selected from the group consisting of synthetic rubber, latex, elastomeric foam, and a mixture thereof.

10. A watch band assembly as in claim 1 wherein said first buckle device and said second buckle device is a one piece construction fabricated from rubber.

11. A watch band assembly as in claim 9 wherein said first buckle device and said second buckle device is a one piece construction fabricated from rubber.

12. A watch band assembly used in combination with a watch comprising:

a first buckle device and a second buckle device;

said first buckle device and said second buckle device are adapted to be are removably secured to said watch;

a strap assembly;

said strap assembly comprises at least one elongated hollow integral tubular resilient member having opposite ends which are opened and said at least one elongated hollow integral tubular resilient member maintains a hollow integral tubular shape when stretched;

said opposite ends of said strap assembly are removably secured to said first buckle device and said second buckle device, respectively, via an attaching means;

said attaching means provides for said first buckle device and said second buckle device to each include a first end and a second end;

at least one stud extends downwardly from each said second end which removably receive said opposite ends;

said at least one stud includes an inner end and an outer end;

said outer end receives said strap assembly; and said inner end to said outer end gradually decreases in width for providing for said stud to be tapered inwardly from said inner end to said outer end wherein each said buckle device include a front surface and a back surface, said front surface includes a plurality of first grooves that are horizontally disposed with respect to said first end and said second end, said back surface includes a plurality of second grooves that are horizontally disposed with respect to said first end and said second end wherein said plurality of first grooves and said plurality of second grooves constitute a flexing means allowing each said buckle device to be rigid yet flexible.

13. A watch band assembly as in claim 12 wherein said plurality of first grooves are displaced from said plurality of second grooves.

14. A watch band assembly as in claim 12 wherein said at least one elongated hollow tubular resilient member comprised of a material selected from the group consisting of synthetic rubber, latex, elastomeric foam, and a mixture thereof.

* * * * *